US007674207B1

(12) United States Patent
Weaver et al.

(10) Patent No.: US 7,674,207 B1
(45) Date of Patent: Mar. 9, 2010

(54) BUCKET WALKER SYSTEM

(76) Inventors: Donald W. Weaver, 6530 Bimini Ct., Apollo Beach, FL (US) 33572; Charles E. Waltz, III, 308 Flamingo Dr., Apollo Beach, FL (US) 33572

( * ) Notice: Subject to any disclaimer, the term of this patent is extended or adjusted under 35 U.S.C. 154(b) by 162 days.

(21) Appl. No.: 12/077,874

(22) Filed: Mar. 21, 2008

(51) Int. Cl.
*A63B 25/00* (2006.01)

(52) U.S. Cl. ..... 482/75

(58) Field of Classification Search ..... 482/51, 482/75–76, 105, 142, 145; 135/65; 623/27–29; 446/26; 473/207, 217; D21/422; 36/1, 81, 36/114, 116, 132, 136; 441/76; *A63B 25/00*
See application file for complete search history.

(56) References Cited

U.S. PATENT DOCUMENTS 2,651,790 A * 9/1953 Geiger ..... 441/76
4,176,459 A * 12/1979 Perser et al. ..... 33/515
4,255,822 A 3/1981 Dixon
5,177,883 A * 1/1993 Darby ..... 36/97
5,593,373 A 1/1997 Hale

* cited by examiner

*Primary Examiner*—Loan H Thanh
*Assistant Examiner*—Oren Ginsberg

(57) ABSTRACT

A coupling assembly is adapted to removably couple an associated bucket to an associated foot of a user. The coupling assembly includes a lower component. The lower component is adapted to encompass an associated bucket. The coupling assembly also includes an upper component. The upper component is formed as a strap. The upper component is adapted to couple with respect to a foot of a user. The coupling assembly also includes an intermediate component. The intermediate component is formed as a plurality of vertical straps. The straps couple the upper and lower components.

8 Claims, 3 Drawing Sheets

FIG 1
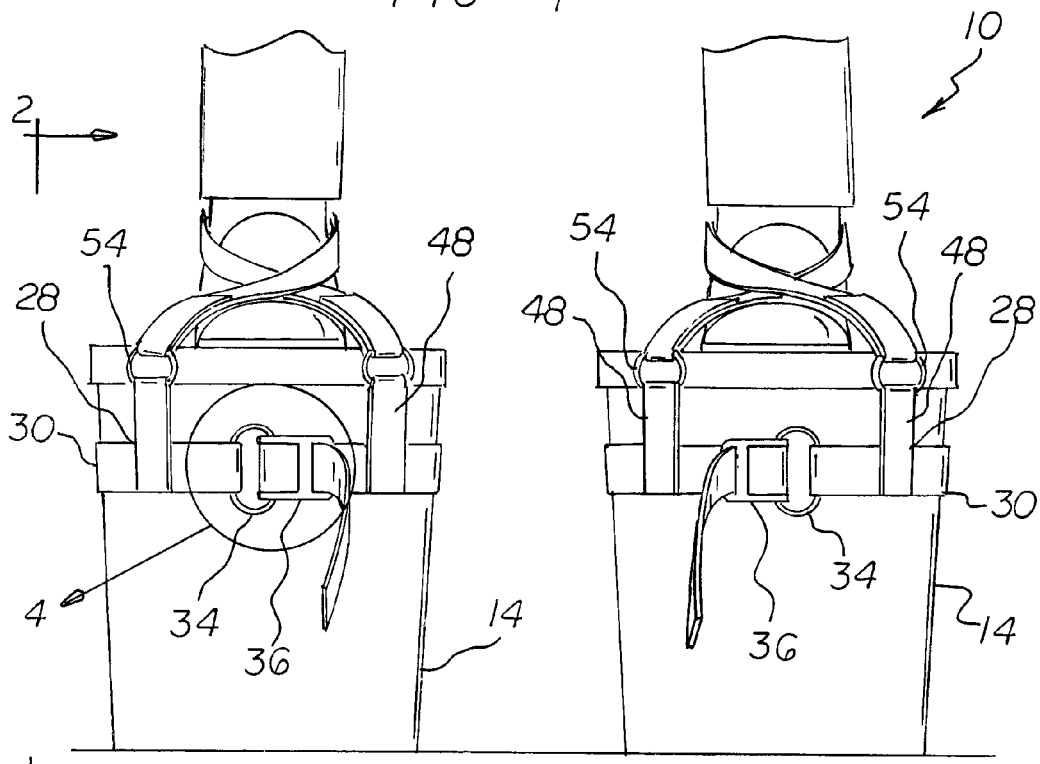
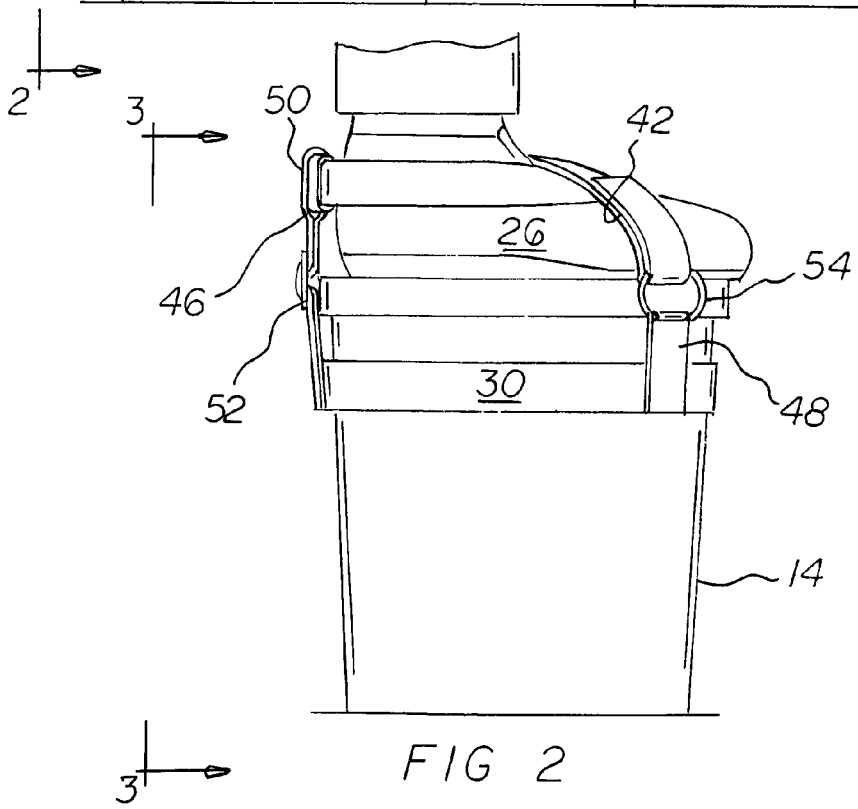
FIG 2

FIG 3
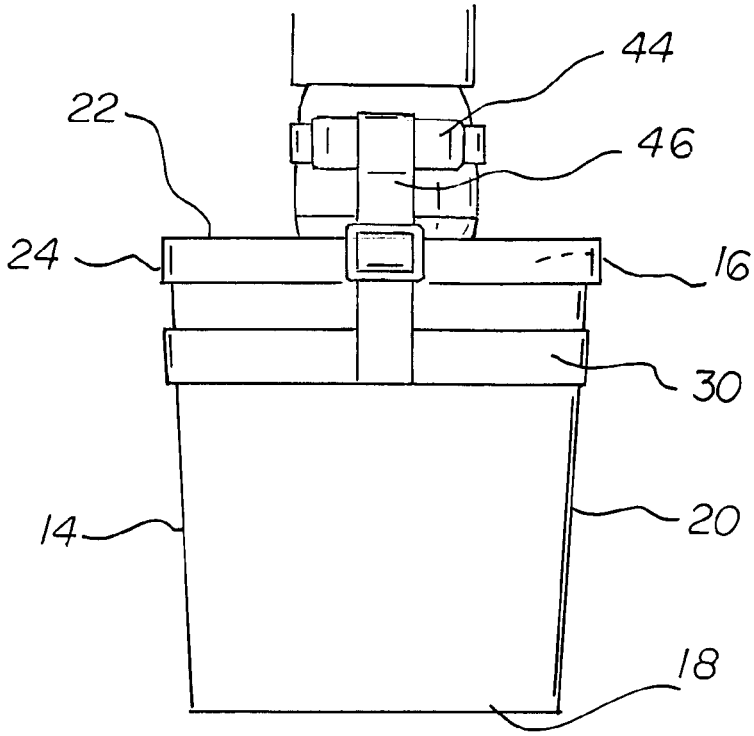
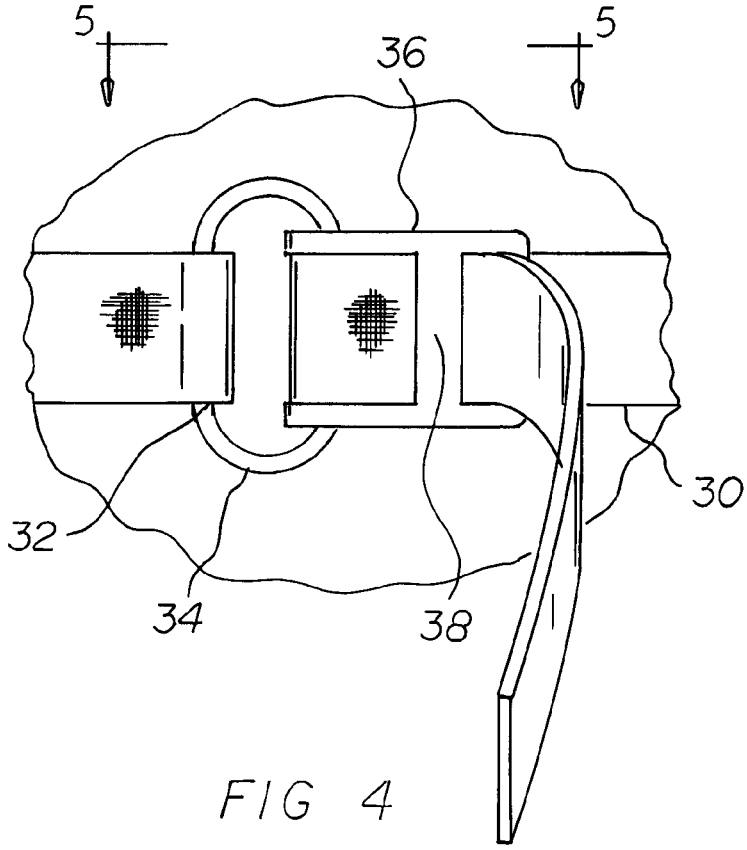
FIG 4

FIG 5
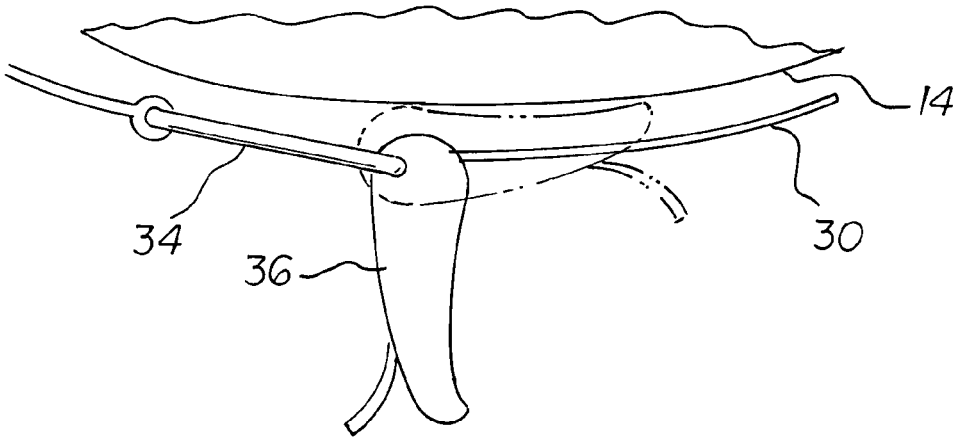
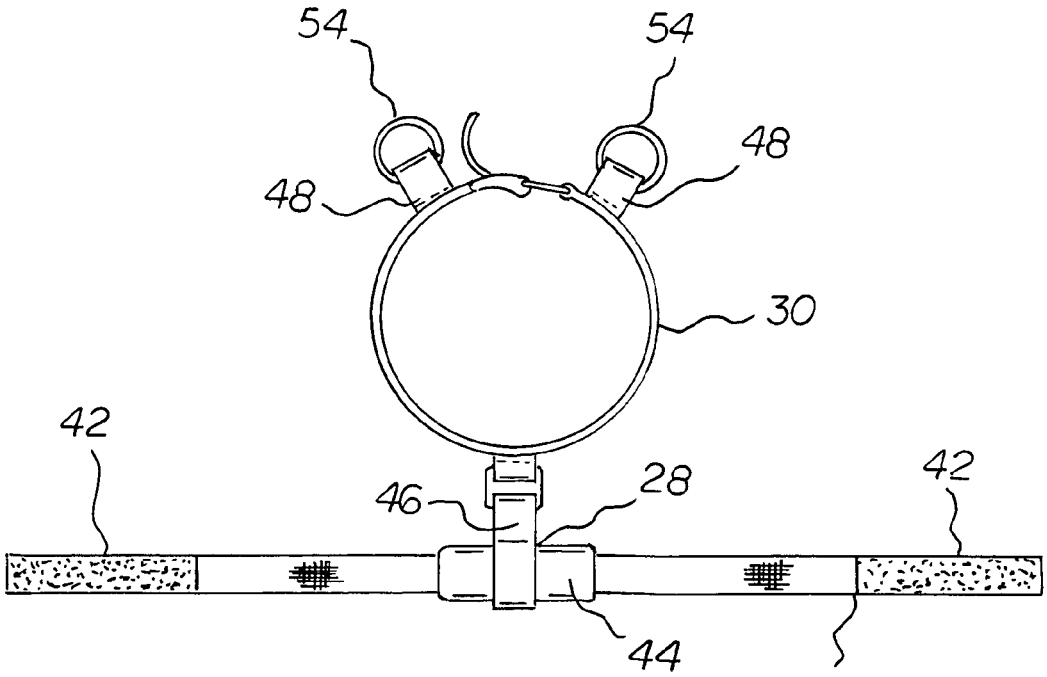
FIG 6

BUCKET WALKER SYSTEM

BACKGROUND OF THE INVENTION

1. Field of the Invention

The present invention relates to a bucket walker system and more particularly pertains to assisting a user in standing and walking about at an elevated height in a safe, convenient and economical manner.

2. Description of the Prior Art

The use of stilt systems of known designs and configurations is known in the prior art. More specifically, stilt systems of known designs and configurations previously devised and utilized for the purpose of elevating a user through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,255,822 issued Mar. 17, 1981 to Dixon relates to Shoe Holder Adapters for Stiff Platform and U.S. Pat. No. 5,593,373 issued Jan. 14, 1997 to Hale relates to an Economical Foot Connected Stilt Assembly.

While these devices fulfill their respective, particular objectives and requirements, the aforementioned patents do not describe a bucket walker system that allows for assisting a user in standing and walking about at an elevated height in a safe, convenient and economical manner.

In this respect, the bucket walker system according to the present invention substantially departs from the conventional concepts and designs of the prior art, and in doing so provides an apparatus primarily developed for the purpose of assisting a user in standing and walking about at an elevated height in a safe, convenient and economical manner.

Therefore, it can be appreciated that there exists a continuing need for a new and improved bucket walker system which can be used for assisting a user in standing and walking about at an elevated height in a safe, convenient and economical manner. In this regard, the present invention substantially fulfills this need.

SUMMARY OF THE INVENTION

In view of the foregoing disadvantages inherent in the known types of stilt systems of known designs and configurations now present in the prior art, the present invention provides an improved bucket walker system. As such, the general purpose of the present invention, which will be described subsequently in greater detail, is to provide a new and improved bucket walker system and method which has all the advantages of the prior art and none of the disadvantages.

To attain this, the present invention essentially comprises a bucket walker system. First provided is a pair of similarly configured buckets. Each bucket has a circular top. The circular top has a first diameter. Each bucket has a circular bottom. The circular bottom has a second diameter. Each bucket has a tapering sidewall. The sidewall is provided between the top and the bottom. The top has a greater diameter than the bottom in the preferred embodiment. Each bucket has a front. Note FIG. 1. Each bucket has a rear. Note FIG. 2. Each bucket has interior and exterior sides. Note FIG. 3. Each bucket also has a lid. The lid has a circular periphery. The lid has an essentially cylindrical lip. The lip extends downwardly from the periphery. The lip removably encompasses the top of the bucket. In this manner stability is added to each bucket.

A pair of similarly configured shoes is provided. Each shoe has a heel. Each shoe has a toe. Each shoe has a sole below. Each shoe has an instep above. The instep is provided between the heel and the toe. Each shoe is adapted to be worn on a foot of a user of the system. Each shoe is positionable on an associated bucket and lid.

Further provided is a pair of similarly configured coupling assemblies. Each coupling assembly is adapted to removably couple an associated bucket to an associated shoe. Each coupling assembly includes a lower component. The lower component encompasses an associated bucket adjacent to the lip of the lid. Each lower component has a first free end. In this manner a primary loop is formed. The lower component has a rigid primary ring. The primary ring is provided in a generally rectangular configuration. The primary ring is supported by the primary loop. Each lower component has a second free end. The second free end slidably passes through the primary ring. The lower component has a lever. The lever is pivotably mounted on the primary ring. The lower component has a horizontal slider. The horizontal slider is adapted to allow the lower component to be lengthened and shortened for securement to buckets of different sizes. The lever is positioned adjacent to the front of the bucket. The lever is movable by a user between a locking orientation and an unlocking orientation. In the locking orientation the lever is adjacent to the bucket. Note FIG. 5, dotted lines. In this manner the lower component may be secured to the bucket. In the unlocking orientation the lever is remote from the bucket. Note FIG. 5, solid lines. In this manner the lower component may be separated from the bucket.

Each coupling assembly includes an upper component. The upper component is formed as a single strap. The strap has remote ends. The strap has a central extent. The strap has hook and loop fasteners. The hook and loop fasteners are attached to each remote end. The strap has a soft pad. The soft pad is attached to the central extent. The strap is positioned with the soft pad in contact with the heel of the shoe and the remote ends extending forward toward the toe of the shoe and crossing above the instep of the shoe.

Each coupling assembly includes an intermediate component. The intermediate component is formed as a plurality of vertical straps. The vertical straps include a rearward strap 46. The rearward strap has an upper extent. The upper extent forms a rearward loop. The rearward loop slidably receives the soft pad of the upper component. The rearward strap has a lower extent. The lower extent is stitched to the lower component at the back of the bucket. The rearward strap also includes a vertical slider. The vertical slider is provided between the upper and lower extents. In this manner the length of the rearward strap and the distance between the upper and lower components may be varied. The vertical straps also include two similarly configured forward straps. The forward straps are provided adjacent to the front of the bucket on opposite sides of the lever. Each forward strap has a lower end. The lower end is stitched to the lower extent. Each forward strap has an upper end. The upper end forms a top loop. A circular ring is provided in the top loop. The circular ring also receives the remote ends of the upper component. The remote ends form an adjustable loop. The adjustable loop is removably retained in position by the hook and loop fastener. All of the straps of the components are fabricated of flexible, essentially inextensible material. All of the straps are about 2 inches in width. The lower component has a length of about 50 inches. The upper component has a length of about 40 inches. The rear strap has a length of about 16 inches.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bucket walker system which has all of the advantages of the prior art stilt systems of known designs and configurations and none of the disadvantages.

It is another object of the present invention to provide a new and improved bucket walker system which may be easily and efficiently manufactured and marketed.

It is further object of the present invention to provide a new and improved bucket walker system which is of durable and reliable constructions.

An even further object of the present invention is to provide a new and improved bucket walker system which is susceptible of a low cost of manufacture with regard to both materials and labor, and which accordingly is then susceptible of low prices of sale to the consuming public, thereby making such bucket walker system economically available to the buying public.

Even still another object of the present invention is to provide a bucket walker system for assisting a user in standing and walking about at an elevated height in a safe, convenient and economical manner.

Lastly, it is an object of the present invention to provide a new and improved bucket walker system. A coupling assembly is adapted to removably couple an associated bucket to an associated foot of a user. The coupling assembly includes a lower component. The lower component is adapted to encompass an associated bucket. The coupling assembly also includes an upper component. The upper component is formed as a strap. The upper component is adapted to couple with respect to a foot of a user. The coupling assembly also includes an intermediate component. The intermediate component is formed as a plurality of vertical straps. The straps couple the upper and lower components.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a bucket walker system constructed in accordance with the principles of the present invention.

FIG. 2 is a side elevational view of the system taken along line 2-2 of FIG. 1.

FIG. 3 is a rear elevational view of the system taken along line 3-3 of FIG. 2.

FIG. 4 is an enlarged front elevational view of a portion of the system taken at Circle 4 of FIG. 1.

FIG. 5 is a plan view of the system taken along line 5-5 of FIG. 4.

FIG. 6 is a plan view of one coupling assembly separated from its bucket.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved bucket walker system embodying the principles and concepts of the present invention and generally designated by the reference numeral 10 will be described.

The present invention, the bucket walker system 10 is comprised of coupling components. Such components are individually configured and correlated with respect to each other so as to attain the desired objective.

First provided is a pair of similarly configured buckets 14. Each bucket has a circular top 16. The circular top has a first diameter. Each bucket has a circular bottom 18. The circular bottom has a second diameter. Each bucket has a tapering sidewall 20. The sidewall is provided between the top and the bottom. The top has a greater diameter than the bottom in the preferred embodiment. Each bucket has a front. Note FIG. 1. Each bucket has a rear. Note FIG. 3. Each bucket has interior and exterior sides. Note FIG. 2. Each bucket also has a lid 22. The lid has a circular periphery. The lid has an essentially cylindrical lip 24. The lip extends downwardly from the periphery. The lip removably encompasses the top of the bucket. In this manner stability is added to each bucket.

A pair of similarly configured shoes 26 is provided. Each shoe has a heel. Each shoe has a toe. Each shoe has a sole below. Each shoe has an instep above. The instep is provided between the heel and the toe. Each shoe is adapted to be worn on a foot of a user of the system. Each shoe is positionable on an associated bucket and lid.

Further provided is a pair of similarly configured coupling assemblies 28. Each coupling assembly is adapted to removably couple an associated bucket to an associated shoe. Each coupling assembly includes a lower component 30. The lower component encompasses an associated bucket adjacent to the lip of the lid. Each lower component has a first free end. In this manner a primary loop 32 is formed. The lower component has a rigid primary ring 34. The primary ring is provided in a generally rectangular configuration. The primary ring is supported by the primary loop. Each lower component has a second free end. The second free end slidably passes through the primary ring. The lower component has a lever 36. The lever is pivotably mounted on the primary ring. The lower component has a horizontal slider 38. The horizontal slider is adapted to allow the lower component to be lengthened and shortened for securement to buckets of different sizes. The lever is positioned adjacent to the front of the bucket. The lever is movable by a user between a locking orientation and an unlocking orientation. In the locking orientation the lever is adjacent to the bucket. Note FIG. 5, dotted lines. In this manner the lower component may be secured to the bucket. In the unlocking orientation the lever is remote from the bucket. Note FIG. 5, solid lines. In this manner the lower component may be separated from the bucket.

Each coupling assembly includes an upper component 40. The upper component is formed as a single strap. The strap has remote ends. The strap has a central extent. The strap has hook and loop fasteners 42. The hook and loop fasteners are attached to each remote end. The strap has a soft pad 44. The soft pad is attached to the central extent. The strap is positioned with the soft pad in contact with the heel of the shoe and the remote ends extending forward toward the toe of the shoe and crossing above the instep of the shoe.

Each coupling assembly includes an intermediate component. The intermediate component is formed as a plurality of vertical straps 46, 48. The vertical straps include a rearward strap 46. The rearward strap has an upper extent. The upper extent forms a rearward loop 50. The rearward loop slidably receives the soft pad of the upper component. The rearward strap has a lower extent. The lower extent is stitched to the lower component at the back of the bucket. The rearward strap also includes a vertical slider 52. The vertical slider is provided between the upper and lower extents. In this manner the length of the rearward strap and the distance between the upper and lower components may be varied. The vertical straps also include two similarly configured forward straps 48. The forward straps are provided adjacent to the front of the bucket on opposite sides of the lever. Each forward strap has a lower end. The lower end is stitched to the lower extent. Each forward strap has an upper end. The upper end forms a top loop. A circular ring 54 is provided in the top loop. The circular ring also receives the remote ends of the upper component. The remote ends form an adjustable loop. The adjustable loop is removably retained in position by the hook and loop fastener. All of the straps of the components are fabricated of flexible, essentially inextensible material. All of the straps are about 2 inches in width. The lower component has a length of about 50 inches. The upper component has a length of about 40 inches. The rear strap has a length of about 16 inches.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bucket walker system comprising:

a bucket having a circular top and circular bottom with a tapering sidewall;

a coupling assembly adapted to removably couple the bucket to an associated foot of a user, the coupling assembly including a lower component adapted to encompass the bucket, the bucket removably receiving and supporting the lower component, the lower component forms a loop around the entire circumference of the bucket;

the coupling assembly also including an upper component formed as a strap adapted to couple with respect to the foot of the user; and the coupling assembly also including an intermediate component formed as a plurality of vertical straps coupling the upper and lower components.

2. The system as set forth in claim 1 wherein the top has a greater diameter than the bottom.

3. The system as set forth in claim 1 and further including:

a shoe having a heel and a toe with a sole below and an instep above between the heel and the toe, each shoe adapted to be worn on the foot of the user of the system, each shoe adapted to be positioned on the bucket.

4. The system as set forth in claim 1 wherein the lower component has a first free end forming a primary loop with a rigid primary ring in a generally rectangular configuration supported by the primary loop, each lower component having a second free end slidably passing through the primary ring with a lever pivotably mounted on the primary ring and a horizontal slider adapted to allow the lower component to be lengthened and shortened for securement to buckets of different sizes, the lever being positioned adjacent to the front of the bucket and movable by the user between a locking orientation and an unlocking orientation.

5. The system as set forth in claim 3 wherein the upper component is formed as a single strap with remote ends and a central extent, hook and loop fasteners attached to each remote end and a soft pad attached to the central extent, the strap positioned with the soft pad in contact with the heel of the shoe and the remote ends extending forward toward the toe of the shoe and crossing above the instep of the shoe.

6. The system as set forth in claim 1 wherein the intermediate component is formed as a plurality of vertical straps including a rearward strap with an upper extent forming a rearward loop slidably receiving the upper component and with a lower extent stitched to the lower component at the back of the bucket, the rearward strap also including a vertical slider between the upper and lower extents for varying the length of the rearward strap and the distance between the upper and lower components, the vertical straps also including two similarly configured forward straps adjacent to the front of the bucket on opposite sides of the lever, each forward strap having a lower end stitched to the lower extent and an upper end forming a top loop with a circular ring in the top loop, the circular ring also receiving the remote ends of the upper component with the remote ends forming an adjustable loop removably retained in position by a hook and loop fastener.

7. The system as set forth in claim 1 wherein all of the components include a flexible, essentially inextensible material.

8. A bucket walker system for assisting a user in standing and walking about at an elevated height in a safe, convenient and economical manner, the system comprising, in combination:

a pair of similarly configured buckets, each bucket having a circular top of a first diameter and a circular bottom of a second diameter with a tapering sidewall between the top and the bottom, the top having a greater diameter than the bottom, each bucket having a front and a rear with interior and exterior sides, each bucket also having a lid with a circular periphery and an essentially cylindrical lip extending downwardly from the periphery and removably encompassing the top of the bucket to add stability to each bucket;

a pair of similarly configured shoes, each shoe having a heel and a toe with a sole below and an instep above between the heel and the toe, each shoe adapted to be worn on a foot of the user of the system, each shoe being positionable on an associated bucket and lid; and a pair of similarly configured coupling assemblies, each coupling assembly adapted to removably couple an associated bucket to an associated shoe, each coupling assembly including a lower component encompassing the associated bucket adjacent to the lip of the lid, each lower component having a first free end forming a primary loop with a rigid primary ring in a generally rectangular configuration supported by the primary loop, each lower component having a second free end slidably passing through the primary ring with a lever pivotably mounted on the primary ring and a horizontal slider adapted to allow the lower component to be lengthened and shortened for securement to buckets of different sizes, the lever being positioned adjacent to the front of the bucket and movable by the user between a locking orientation adjacent to the bucket for securement purposes an unlocking orientation remote from the bucket for separation;

each coupling assembly including an upper component formed as a single strap with remote ends and a central extent, hook and loop fasteners attached to each remote end and a soft pad attached to the central extent, the strap positioned with the soft pad in contact with the heel of the shoe and the remote ends extending forward toward the toe of the shoe and crossing above the instep of the shoe; and each coupling assembly including an intermediate component formed as a plurality of vertical straps, the vertical straps including a rearward strap with an upper extent forming a rearward loop slidably receiving the soft pad of the upper component and with a lower extent stitched to the lower component at the back of the bucket, the rearward strap also including a vertical slider between the upper and lower extents for varying the length of the rearward strap and the distance between the upper and lower components, the vertical straps also including two similarly configured forward straps adjacent to the front of the bucket on opposite sides of the lever, each forward strap having a lower end stitched to the lower extent and an upper end forming a top loop with a circular ring in the top loop, the circular ring also receiving the remote ends of the upper component with the remote ends forming an adjustable loop removably retained in position by the hook and loop fastener, all of the straps of the components being fabricated of flexible, essentially inextensible material about 2 inches in width with the lower component having a length of about 50 inches, with the upper component having a length of about 40 inches and with the rear strap having a length of about 16 inches.

* * * * *